US008307806B2

(12) United States Patent
Mariano et al.

(10) Patent No.: US 8,307,806 B2
(45) Date of Patent: Nov. 13, 2012

(54) DEVICE FOR ACTUATING THE DECOMPRESSION ENGINE BRAKE IN AN INTERNAL COMBUSTION ENGINE

(75) Inventors: Daniele Mariano, Turin (IT); Mathias Binder, Arbon (CH)

(73) Assignee: Iveco S.p.A. (IT)

( * ) Notice: Subject to any disclaimer, the term of this patent is extended or adjusted under 35 U.S.C. 154(b) by 509 days.

(21) Appl. No.: 12/733,084

(22) PCT Filed: Aug. 5, 2008

(86) PCT No.: PCT/EP2008/060274

§ 371 (c)(1),
(2), (4) Date: Feb. 5, 2010

(87) PCT Pub. No.: WO2009/019269

PCT Pub. Date: Feb. 12, 2009

(65) Prior Publication Data

US 2010/0139616 A1 Jun. 10, 2010

(30) Foreign Application Priority Data

Aug. 6, 2007 (EP) ..... 07425512

(51) Int. Cl.
*F02D 13/04* (2006.01)
*F01L 1/18* (2006.01)

(52) U.S. Cl. ..... 123/321; 129/90.44

(58) Field of Classification Search ..... 123/90.15, 123/90.16, 90.17, 90.44, 320, 321, 324, 348
See application file for complete search history.

(56) References Cited

U.S. PATENT DOCUMENTS

| | | | | |
|---|---|---|---|---|
| 4,711,210 | A | 12/1987 | Reichenbach | |
| 6,769,387 | B2 * | 8/2004 | Hayman et al. | 123/90.39 |
| 7,318,399 | B2 * | 1/2008 | Methley | 123/90.16 |
| 2006/0005796 | A1 * | 1/2006 | Janak et al. | 123/90.16 |
| 2007/0074689 | A1 * | 4/2007 | Methley | 123/90.16 |
| 2010/0186710 | A1 * | 7/2010 | Persson et al. | 123/321 |

FOREIGN PATENT DOCUMENTS

| | | |
|---|---|---|
| DE | 4025569 | 7/1991 |

* cited by examiner

*Primary Examiner* — Stephen K Cronin
*Assistant Examiner* — Sherman Manley
(74) *Attorney, Agent, or Firm* — Stetina Brunda Garred & Brucker

(57) ABSTRACT

A device for actuating the decompression engine brake in an internal combustion engine provided with hydraulic tappets is described, characterized by: an additional rocker arm (9) for each cylinder, pivoting about an axis (4) common to the rocker arms of the exhaust valves, and suitable to engage with a corresponding additional cam (10) arranged on the cam axis (7) of the cylinders; an actuator system for said additional rocker arm (9), for each cylinder. In the actuator system of said additional rocker arm (9) there is a piston (15) hinged to an end of said rocker arm, said piston (15) being in its turn moved hydraulically or by a mechanical system comprising an additional arm (12) controlled by eccentric cams (13).

11 Claims, 6 Drawing Sheets

DEVICE FOR ACTUATING THE DECOMPRESSION ENGINE BRAKE IN AN INTERNAL COMBUSTION ENGINE

FIELD OF THE INVENTION

The present invention relates to a device for actuating the engine brake in an internal combustion engine and, more specifically, to a device for actuating the decompression engine brake in an internal combustion engine provided with hydraulic tappets.

PRIOR ART

Systems are known in the prior art in which an additional exhaust valve or flap is added to increase the pressure, pressurize the engine and increase braking power.

However, such systems are inadequate for high power applications.

For applications involving high inertia loads, for example in the case of heavy goods vehicles, compression release engine braking systems are used, in which the exhaust valve (s) is (are) opened prematurely with respect to the piston motion. This is effected by additional openings of the exhaust valves by means of specific actuators.

For example an additional opening of the exhaust valves can be effected by means of an additional cam lift at the end of the compression stage, with a cam advance of approx. 70 degrees.

Therefore the principle of braking the engine inertia is based on the decompression in the combustion chamber during the compression stage stroke is already known in the art. Such systems use the energy accumulated in the form of pressure during the air compression cycle to "brake" the inertia or mass connected to the crankshaft.

Some of the decompression engine braking systems known in the art are used in engines provided with mechanical tappets. These however are more robust than hydraulic tappets, and also accept loads with a horizontal component, which simplifies the actuating mechanisms required to actuate the decompression.

Engines provided with hydraulic tappets however present an additional problem in that such tappets are more fragile than the mechanical ones.

In order to work, hydraulic tappets always require a minimum vertical load, which provides a constant (at least minimum) pressing force, otherwise they expand too much and risk being damaged.

Moreover, hydraulic tappets are able to withstand loads with a vertical component, but can only accept loads with a modest horizontal component. A horizontal component could cause permanent damage.

Therefore devices and/or actuators must be provided which increase the complexity of the mechanisms, and the problem arises of the need for solutions that are not excessively complicated, bulky or expensive.

SUMMARY OF THE INVENTION

Therefore the aim of the present invention is to overcome the drawbacks and disadvantages of the prior art with a decompression braking device for an internal combustion engine provided with hydraulic tappets that is extremely simple to produce and thus highly reliable.

Another purpose of the present invention is to provide a decompression braking device for an internal combustion engine provided with hydraulic tappets, that is robust, of limited dimensions, requires little maintenance and represents a low cost solution.

The present invention relates to a device for actuating the compression release engine brake in an internal combustion engine, said combustion engine comprising: one or more cylinders in line each provided with one or more exhaust valves; respective rocker arms and hydraulic tappets being connected to said exhaust valves; said rocker arms being provided with a common axis for each cylinder; a cam axis for said one or more cylinders in line, characterized in that it comprises: at least one additional rocker arm for each cylinder, pivoting about said common axis and suitable to engage with a corresponding additional cam arranged on said cam axis; at least one actuator system for said additional rocker arm, for each cylinder. Moreover, the device according to the present invention may advantageously comprise at least an additional shaft provided with one or more additional cams, suitable to determine the motion of said actuator system for each cylinder, so that in a first position of said additional shaft, said additional rocker arm does not come into contact with said one or more additional cams, and in a second position of said additional shaft said additional rocker arm comes into contact with said one or more additional cams to determine the actuation of said engine brake.

As an alternative, the device for actuating the compression release engine brake according to the present invention, may comprise, instead of said additional shaft provided with one or more additional cams, a hydraulic actuator system of the rocker arm, which exploits the oil pressure in the engine circuit.

In particular the present invention relates to a device for actuating the decompression engine brake in an internal combustion engine provided with hydraulic tappets, and the relative engine provided with said device, as described more fully in the claims, which are an integral part of this description.

BRIEF DESCRIPTION OF THE DRAWINGS

The present invention will now be illustrated through the following detailed description of a preferred embodiment of the decompression braking device in an internal combustion engine provided with hydraulic tappets according to the present invention, provided merely by way of example, with the help of the drawings attached hereto in which.

In the drawings the same numbers and letters indicate the same parts and components.

DETAILED DESCRIPTION OF THE INVENTION

Figure 2:
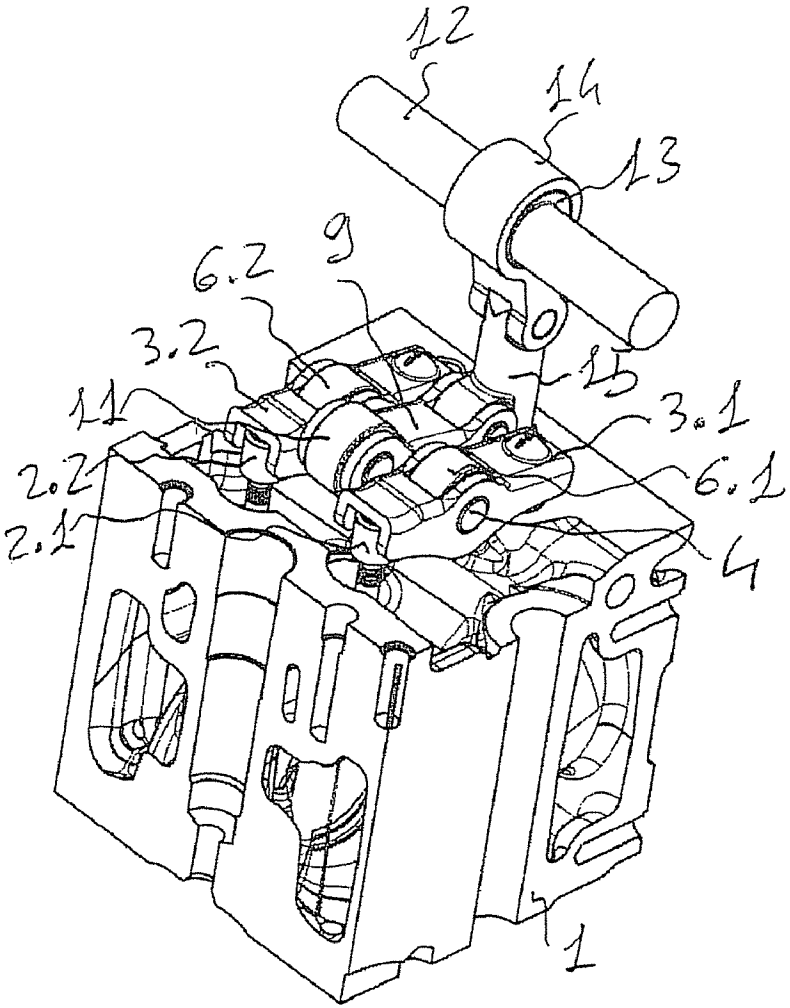
FIGS. 1 to 4 are views from different angles of the part of the cylinder head comprising the device for actuating the engine brake object of this invention, according to a first embodiment comprising an actuator system of said additional rocker arm by using shaft and rocker arms.
Figure 1:
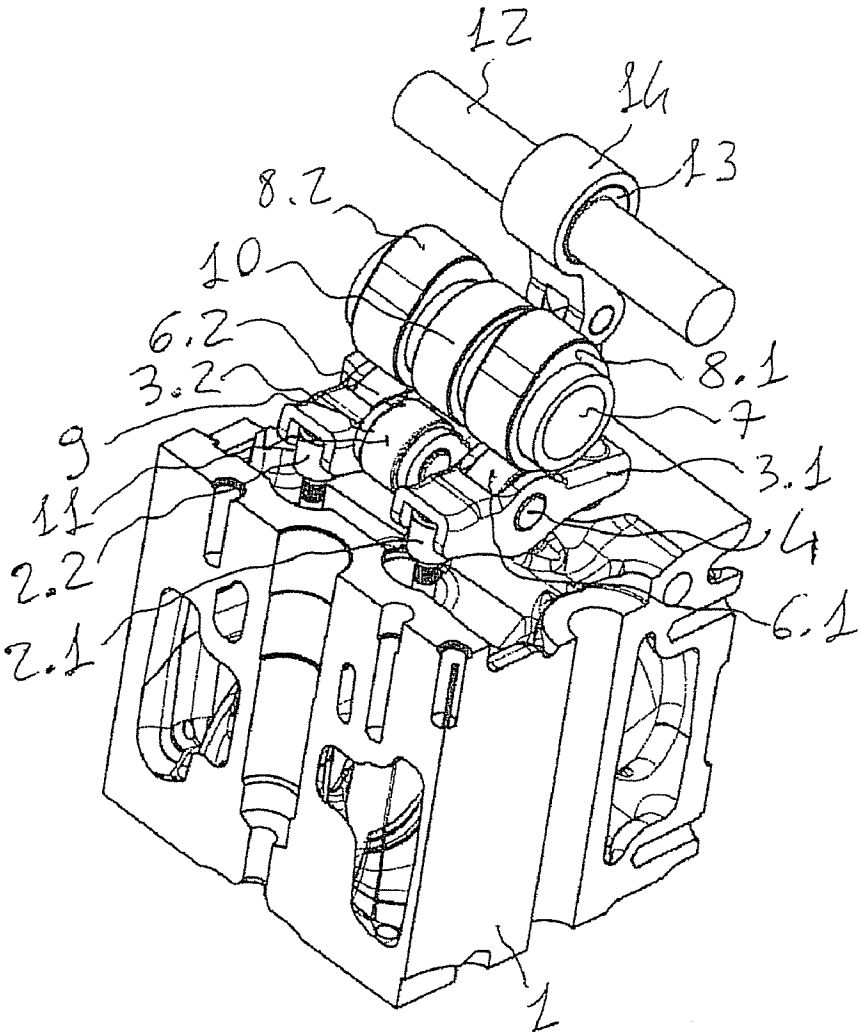
Figure 4:
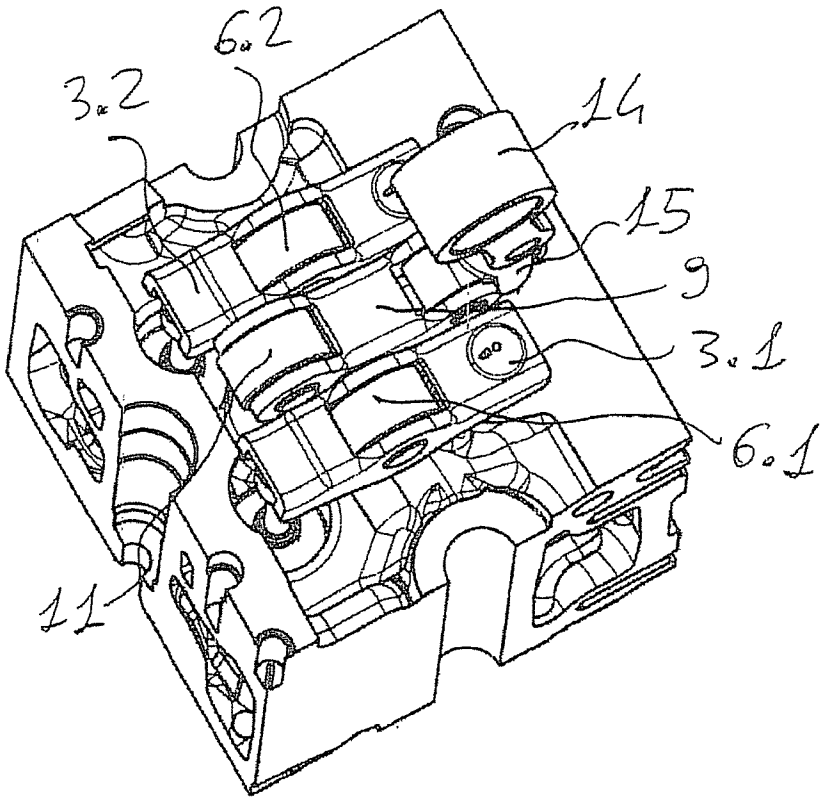
Figure 3:
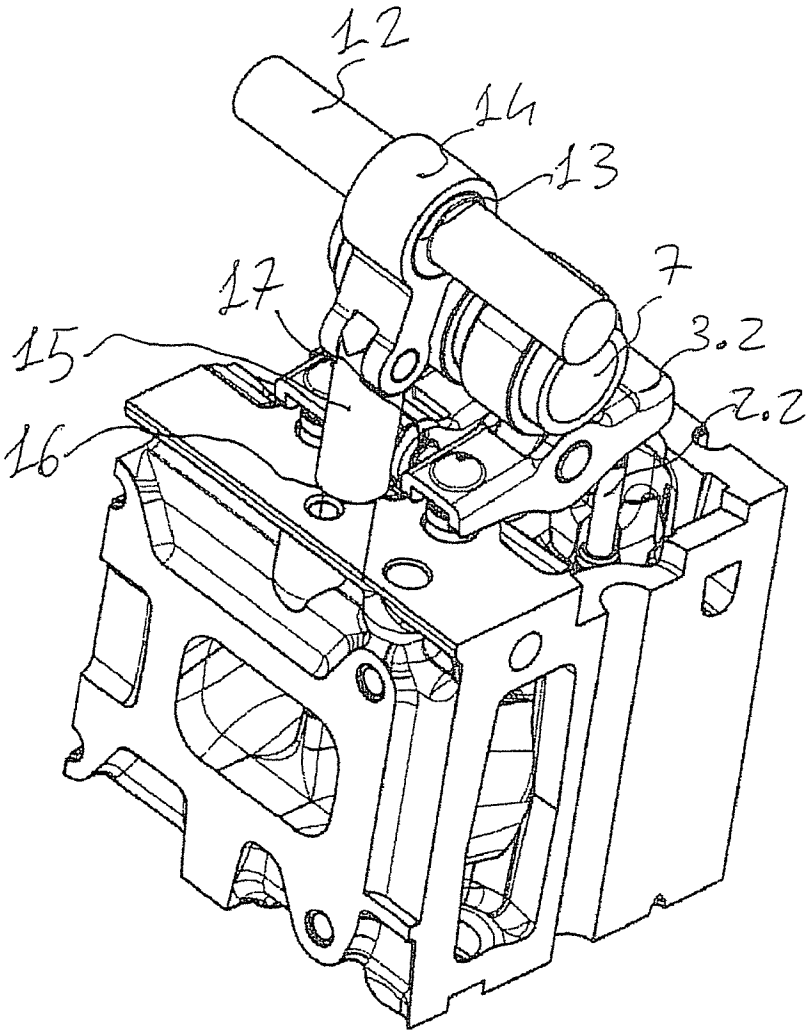
Figure 6:
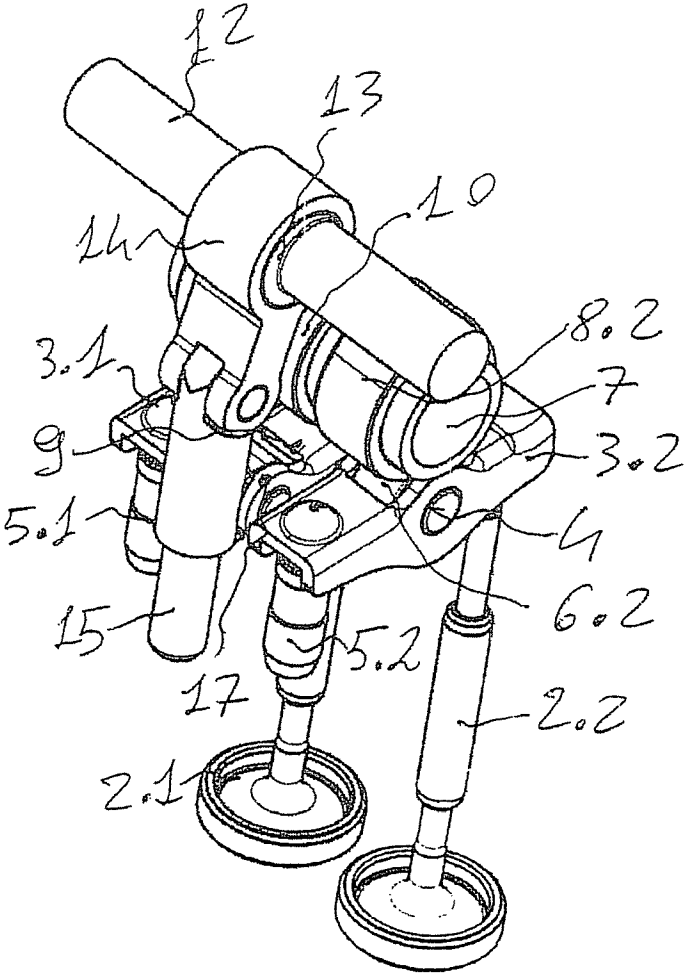
FIGS. 5 and 6 are front and rear perspective views of the device for actuating the engine brake object of this invention according to the first embodiment shown in the figures from 1 to 4.
Figure 5:
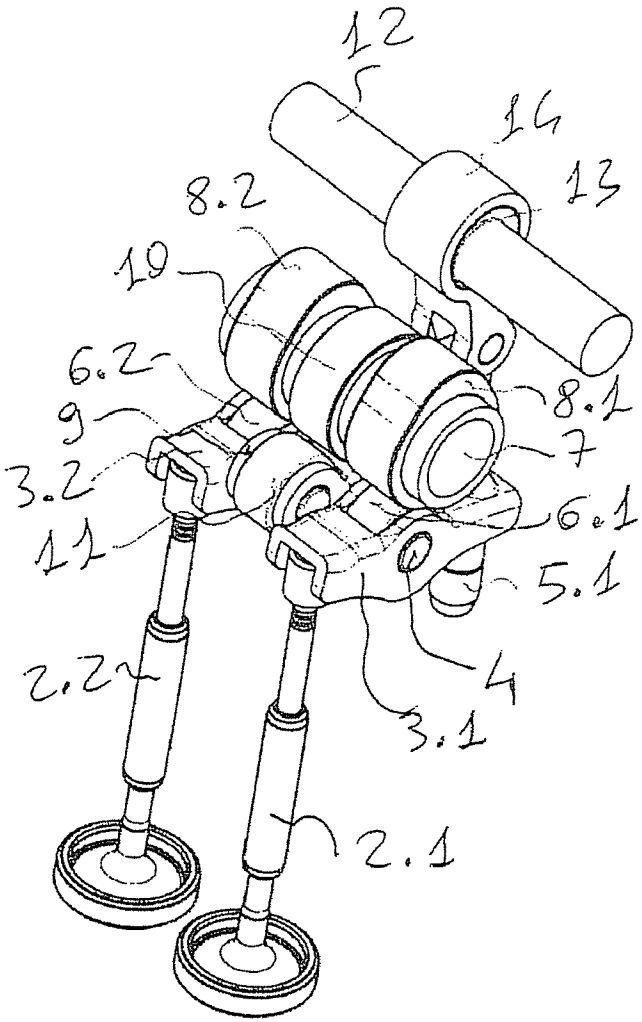

The drawings show a part of the engine block 1 comprising a cylinder of a known type provided with a couple of exhaust valves 2.1 and 2.2, which are joined to one end of respective rocker arms 3.1 and 3.2.

A couple of hydraulic tappets 5.1 and 5.2. are joined to the other end of the rocker arms.

The rocker arms can rotate about a common axis 4 that comprises respective rollers 6.1 and 6.2.

A cam axis 7 arranged in a conventional manner over the rollers 6.1 and 6.2 comprises specific eccentric cams 8.1 and 8.2 for the normal opening/closing of the exhaust valves 2.1 and 2.2.

In the engine there are normally a given number of cylinders in line (not shown in the drawings), which have the cam axis 7 in common.

According to the invention the engine brake function is actuated as follows.

An additional element 9 with the function of a rocker arm (hereinafter referred to as the rocker arm) is inserted and pivots centrally about the same axis 4 that is common to the other two rocker arms 3.1 and 3.2, in an intermediate position between the latter; a third cam with eccentric 10 is included on the existing common cam axis 7.

At one end of the rocker arm 9 (the end towards the exhaust valves) there is a roller 11, while the other end 17 of the rocker arm 9 (towards the hydraulic tappets) is joined to an actuator system. According to a first preferred embodiment of the device according to the present invention, said actuator system comprises an additional shaft 12, provided with a cam 13.

Therefore, according to such first preferred embodiment, in the actuator system an end of a connecting rod 14 is inserted on the cam 13 and the other end of said connecting rod pivots about the end of a piston (or pin) 15, which can slide inside an appropriate retaining housing (hole or recess) 16 in the engine block.

The end 17 of the rocker arm 9 pivots about the piston 15. In operation, the additional shaft 12 can rotate and assume two different angular positions indicated by letters A and B in the drawings. Thanks to the eccentric cam 13, the connecting rod end 14 connected thereto can assume two corresponding positions in order to move the piston 15 to a raised position or a lowered position.

Figure 8:
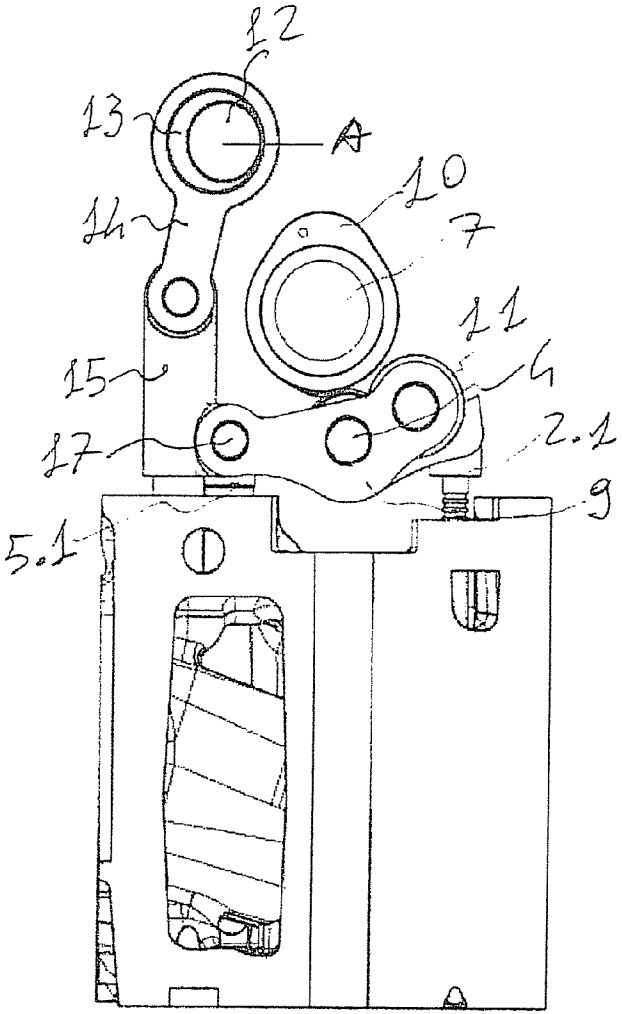
FIGS. 7 and 8 are side views of the part of the cylinder head comprising the device for actuating the engine brake object of this invention according to a first embodiment, respectively with the engine brake activated and deactivated.

In the raised position of the piston 15 (angular position A of the axis 12, FIG. 8) the rocker arm 9 rotates about the axis 4 so as to move the roller 11 away from the eccentric cam 10. In this condition the eccentric cam 10 never comes into contact with the roller 11. In this way the engine brake function is always deactivated.

Figure 7:
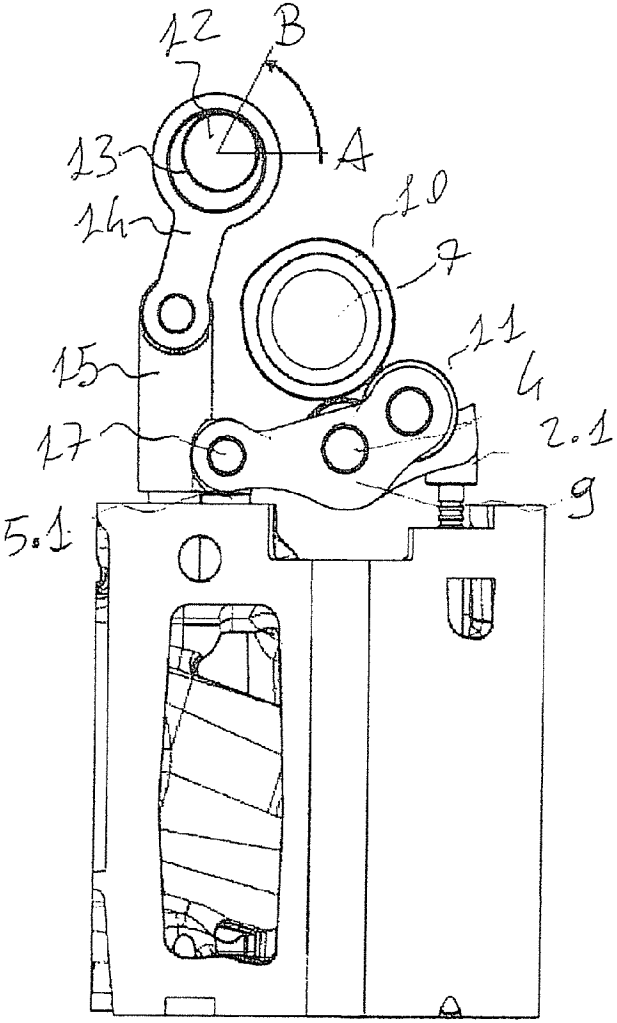

In the lowered position of the piston 15 (angular position B of the axis 12, FIG. 7), the rocker arm 9 rotates about the axis 4 and moves the roller 11 so that it comes into contact with the eccentric cam 10. In this way the engine brake function is activated; in fact the eccentric cam 10 is able to actuate the rocker arm 9 and lower it so as to determine an additional opening of the exhaust valves 2.1 and 2.2, besides that determined by the eccentric cams 8.1 and 8.2 and by the rocker arms 3.1 and 3.2.

When the eccentric cam 10 is placed in an appropriate angular position, the additional opening of the exhaust valves 2.1 and 2.2 is effected in a given phase of the engine cycle, towards the end of the compression phase, with a cam advance of approx. 70 degrees with respect to the normal exhaust phase.

In the example of the embodiment described here there is a distance of approx. 80 degrees between the two angular positions A and B.

In the case of cylinders in line in the engine, the additional shaft 12 is preferably common to all the cylinders in line, and is actuated, for example, by means of a pneumatic actuator, to actuate the engine brake function, by moving it from angular position A to angular position B.

Figure 10:
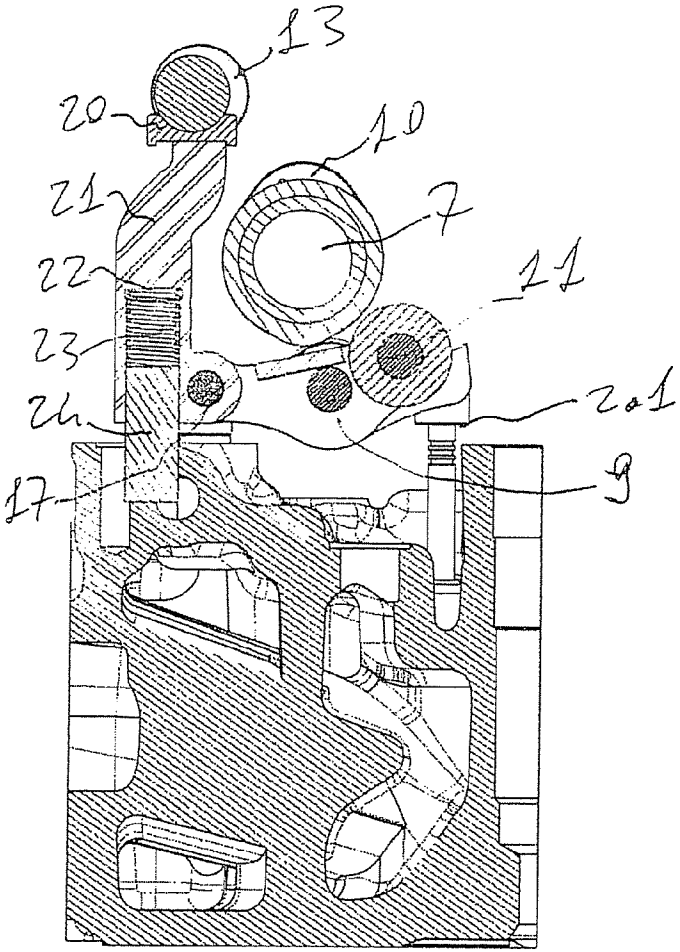
FIGS. 9 and 10 are respectively a rear and side cross-section perspective view of the part of the cylinder head comprising an alternative embodiment of the device for actuating the engine brake according to this invention.
Figure 9:
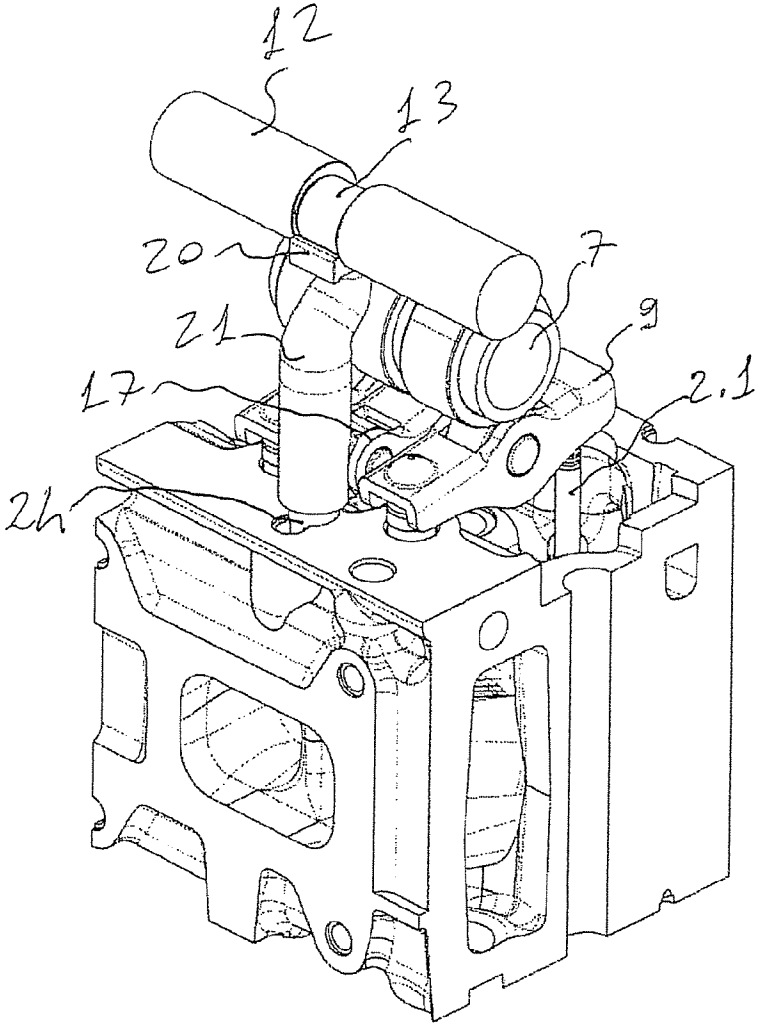

According to a second preferred embodiment of the actuator system of the rocker arm 9 of the device according to the present invention, shown in particular in FIGS. 9 and 10, instead of the connecting rod 14 and the piston 15, there is a cylinder arm and spring system, comprising:

- a supporting plate 20 arranged against the eccentric cam 13 of the shaft 12;
- a first shaped body 21 at the upper end of which said plate 20 is present, and at the other end of which a cavity 22 is present into which a spring 23 is inserted;
- a second cylindrical body 24 set in the head, the outer end of which enters the cavity 22 and engages with the contrast spring 23, which holds the plate 20 against the eccentric cam 13.

The end 17 of the rocker arm 9 pivots about the shaped body 21.

The two angular positions A and B of the eccentric cam 13 determine the lifting or lowering of the plate 20 and of the shaped body 21 contrasted by the spring 23, and the two consequent positions of the rocker arm 9 to actuate or deactivate the engine brake function. The form of the shaped body 21 is such as to adapt the relative positions of the axes of the second cylindrical body 24 and of the additional shaft 12, and guarantee the perfect sliding of the two bodies 21 and 24.

Also, according to a third preferred embodiment of the actuator system of the engine brake device according to the present invention, the rocker arm 9 is hydraulically controlled by exploiting the oil in pressure in the oil engine circuit.

Figure 11:
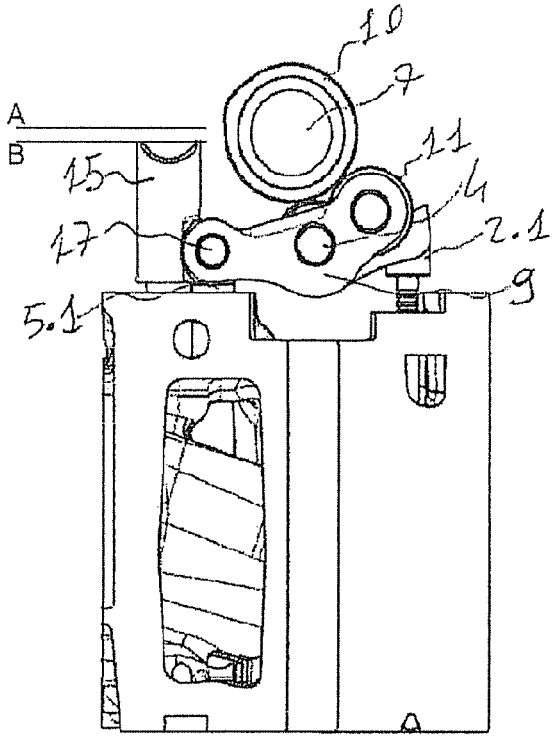
FIGS. 11 and 12 show lateral views of the cylinder head part comprising the device for actuating the engine brake object of this invention according to a third embodiment of the actuator system, respectively in case of activated engine brake or deactivated engine brake.
Figure 12:
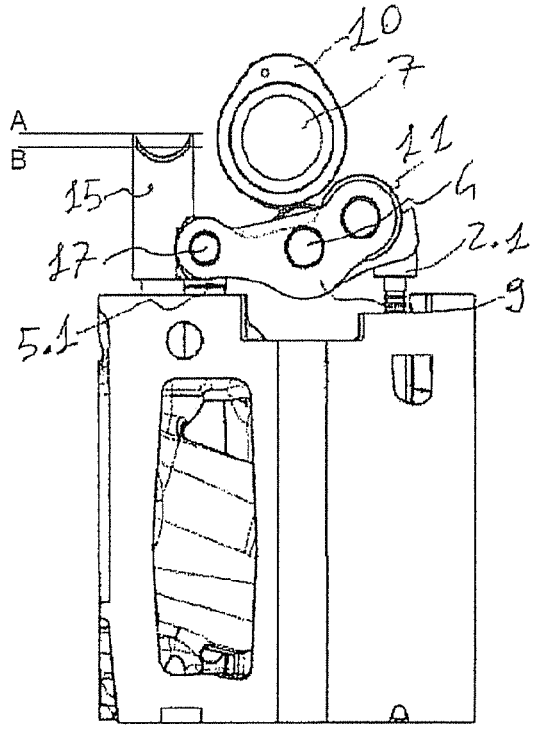

In this case, as shown in FIGS. 11 and 12, neither the additional shaft 12 nor the eccentric cams 13 are present, and the piston 15 is directly activated by the hydraulic circuit. The movement of the piston between a position A of deactivated engine brake, shown in FIG. 12, and a position B of activated engine brake shown in FIG. 11, corresponds to the movement of the additional rocker arm 9, as for the embodiments previously described, between a position wherein the roller 11 does not come into contact with the cam (FIG. 12, deactivated engine brake) and a position wherein the roller 11 comes into contact with the third cam 10 (FIG. 11. activated engine brake).

In this case, as said, the movement of the piston 15 between the position A and the position B is directly controlled by a hydraulic actuator system, this results in a further advantage because additional components such as the additional shaft 12 and the eccentric cam 13 are no longer necessary.

This last alternative embodiment of the hydraulic brake device according to the present invention has therefore a particularly simple construction and installation, being also less bulky so that it can more easily housed in the cylinder head cover.

In the case of engines in which the cylinders have a single exhaust valve, the present invention can be adapted by introducing a few variations within the scope of the invention, for example using the axis 7 of the eccentric cams that control the opening of the exhaust valves, and the axis 4 of the exhaust valve rocker arm, where a double rocker arm can be inserted on said axis 4, so as to "straddle" the one that is already normally present and control this additional opening phase, acting in exactly the same way as the rocker arm 9 described above.

In case of engines with more than one line of cylinders, for example two lines, a device of the type described above is fitted for each line of cylinders.

The decompression braking device according to the present invention has several advantages.

Firstly, the braking device according to the present invention is extremely simple to produce and highly reliable. It absorbs all horizontal loads, eliminating these on the hydraulic tappets, and uses the same axis as the existing tappets.

It introduces a single control axis that is easily installed on the cylinder head, only requiring some slight variations to the production of existing engines, using space that is available on the cylinder head cover. It can be actuated by means of a single control and therefore takes up a limited amount of space, it is robust and requires little maintenance and is therefore a low cost solution.

Moreover the actuator can be of any suitable type; one advantage of the present invention is that it can be mounted on the outside of the engine and in particular on the tappet cover. This means there are no particular problems as regards the compatibility of the actuator with the environment in which it is installed, due for example to temperature, vibrations, the presence of oil.

The use of the engine braking device with hydraulic tappets according to the present invention avoids the need to adjust valve clearance during the engine's working life (maintenance free).

The invention claimed is:

1. Device for actuating a decompression engine brake in an internal combustion engine, said internal combustion engine comprising:

one or more cylinders in line, each provided with one or more exhaust valves;

respective rocker arms and hydraulic tappets connected to said exhaust valves;

said rocker arms being provided with a common axis for each cylinder;

a cam axis for said one or more cylinders in line, characterized in that it comprises:

at least one additional rocker arm, for each cylinder, pivoting about said common axis and suitable to engage with a corresponding additional cam arranged on said cam axis;

at least one actuator system for said additional rocker arm, for each cylinder suitable to move said rocker arm between a first position wherein said rocker arm is not engaged against said additional cam thus determining a deactivated engine brake condition, and a second position wherein said rocker arm is engaged against said additional cam thus determining an activated engine brake condition;

wherein said actuator system of said additional rocker arm for each cylinder comprises at least an additional shaft provided with one or more additional cams suitable for determining the movement of said rocker arm for each cylinder so that in a first position of said additional shaft, said additional rocker arm is in contact with said one or more additional cams determining the activation of said engine brake.

2. Device according to claim 1, wherein said additional shaft is suitable to rotate and assume said first position and said second position as respective angular positions.

3. Device according to claim 1, wherein in the case of two exhaust valves for each cylinder, said at least one additional rocker arm pivots about said common axis in an intermediate position between said two exhaust valves.

4. Device according to claim 1, wherein said additional rocker arm engages with said additional cam via a roller arranged at a first end thereof, the other end of the additional rocker arm pivoting about said actuator system.

5. Device according to claim 4, wherein said actuator system comprises for each cylinder:

a connecting rod an end of which is inserted on said additional cam;

a piston (or pin) about which the end of said connecting rod opposite to said end pivots, said piston being able to slide inside a retaining housing (hole or recess) obtained in said engine, said other end of the additional rocker arm pivoting about said piston.

6. Device according to claim 4, wherein said actuator system comprises for each cylinder:

a supporting plate arranged against said additional cam;

a first shaped body at the upper end of which is said plate, and at the other end of which is a cavity into which a spring is inserted;

a second cylindrical body set in the head of said engine, the outer end of which enters said cavity and engages with said spring, said other end of the additional rocker arm pivoting about said first shaped body.

7. Device according to claim 4, wherein said actuator system comprises for each cylinder:

a piston hydraulically activated by the engine oil circuit, said other end of the additional rocker arm pivoting about said piston and said piston able to move between a first position of deactivated engine brake wherein said roller placed in correspondence of said first end of said rocker arm is disengaged by said additional cam, and a second position of activated engine brake wherein said roller is engaged against said additional cam.

8. Device according to claim 6, wherein the form of said first shaped body is such as to adapt the relative positions of the axes of said second cylindrical body and of said additional shaft.

9. Device according to claim 1, wherein for each cylinder said additional cam is arranged on said cam axis at an angle such as to determine an additional opening of said exhaust valves in a given phase of the engine cycle, towards the end of the compression phase, with a cam advance of approx. 70 degrees with respect to the normal exhaust phase.

10. Device according to claim 1, wherein in the case of several cylinders in line, said additional shaft is common to all the cylinders in line.

11. Internal combustion engine comprising a device for actuating the compression release engine brake according to claim 1.

* * * * *